US006845221B2

(12) United States Patent
Mori et al.

(10) Patent No.: US 6,845,221 B2
(45) Date of Patent: Jan. 18, 2005

(54) IMAGE FORMING APPARATUS AND CONTROL BOARD THEREOF, METHOD FOR RECYCLING THE IMAGE FORMING APPARATUS, AND METHOD FOR RECYCLING THE CONTROL BOARD

(75) Inventors: Hirotaka Mori, Kanagawa (JP); Yosuke Takebe, Kanagawa (JP); Yoshito Ashihara, Kanagawa (JP); Masanori Konno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/382,627

(22) Filed: Mar. 7, 2003

(65) Prior Publication Data

US 2004/0009002 A1 Jan. 15, 2004

(30) Foreign Application Priority Data

Jul. 10, 2002 (JP) ..... P. 2002-201846

(51) Int. Cl.[7] ..... G03G 21/00
(52) U.S. Cl. ..... 399/75
(58) Field of Search ..... 399/75, 223, 302, 399/308, 90, 13, 36, 37

(56) References Cited

U.S. PATENT DOCUMENTS 5,835,814 A * 11/1998 Sawada ..... 399/4
6,148,163 A * 11/2000 Ito ..... 399/67
6,710,898 B2 * 3/2004 Chang ..... 358/474

* cited by examiner

*Primary Examiner*—Quana Grainger
(74) *Attorney, Agent, or Firm*—Morgan, Lewis & Bockius, LLP

(57) ABSTRACT

An image forming apparatus, such as a copier or a printer, in which recyclable components to be discarded are recycled in newly producing an image forming apparatus. The image forming apparatus includes a first image forming section for forming an image of first type, a control board and a first drive circuit. The first drive circuit drives the first image forming section. The first drive circuit is connected to the control board. The control board has a connection section to be connected to a second board on which a second drive circuit for driving a second image forming section is mounted. The second image forming section forms an image of second type.

35 Claims, 11 Drawing Sheets

FIG. 4

| | BOARD | FIRST DRIVE CIRCUIT | SECOND DRIVE CIRCUIT |
|---|---|---|---|
| A | — | K [ALL] | YMC [ALL] |
| B | — | K [ALL] (+YMC [COMMON]) | YMC [OTHERS] |
| C | YMCK [COMMON] | K [OTHERS] | YMC [OTHERS] |
| D | — | YMCK [ALL] | YMCK [HIGHER-LEVEL DIFFERENTIALS] |

IMAGE FORMING APPARATUS AND CONTROL BOARD THEREOF, METHOD FOR RECYCLING THE IMAGE FORMING APPARATUS, AND METHOD FOR RECYCLING THE CONTROL BOARD

BACKGROUND OF THE INVENTION

1. Field of the Invention

The invention relates to an image forming apparatus, and more particularly, to an image forming apparatus and a control board thereof, both being recyclable, to a method for recycling the image forming apparatus, and to a method for recycling the control board.

2. Background Art

In relation to a recent image forming apparatus, such as a copier or a printer, recyclable components constituting an image forming apparatus to be discarded are recycled in newly producing an image forming apparatus, thus addressing environmental issues.

SUMMARY OF THE INVENTION

In association with technological development, image forming apparatus have been improved in terms of functions and performance.

For example, as shown in FIG. 14, a current image forming apparatus is taken as a first generation. An image forming apparatus 301 is assumed to be a monochrome-only machine which can output 60 pages per minute, and an image forming apparatus 302 is assumed to be a color machine which can output 60 monochrome pages per minute and 30 color pages per minute.

In the future, utilization, as a second generation image forming machine, of an image forming apparatus 303 which is a color machine and can produce 60 monochrome pages per minute and 40 color pages per minute is considered.

In this way, in a situation where the performance of the image forming apparatus has been improved, if an attempt is made to recycle components constituting the image forming apparatus, the chances of the components being unadaptable will be increased. Even if high-performance components are utilized at the time of designing a current image forming apparatus in anticipation of a future improvement in performance, future production of an image forming apparatus having an expected configuration is not guaranteed, thereby resulting in high possibility of wasting high-performance components.

Therefore, even when an attempt is made to recycle components constituting an image forming apparatus, future difficulty in recycling the components is assumed to be encountered.

Accordingly, the invention is aimed at providing an image forming apparatus and a control board thereof, which enable maximum recycling of components even when an improvement has arisen in functions or performance of the image forming apparatus; providing a method for recycling the image forming apparatus; and providing a method for recycling the control board.

To achieve the object as above, the invention provides an image forming apparatus, including: a first image forming section for forming an image of first type; a control board; and a first drive circuit for driving the first image forming section; wherein the first drive circuit is connected to the control board; and the control board has a connection section to be connected to a second board on which a second drive circuit for driving a second image forming section is mounted, the second image forming section for forming an image of second type.

The second board may include a plurality of second boards, each having the second drive circuit mutually different in capability; and the plurality of second boards are selectively connected to the connection section.

The first drive circuit may be of higher driving capacity than the second drive circuit.

The image of first type formed by the first image forming section may be a monochrome image, while the image of second type formed by the second image forming section may be a color image.

The image forming apparatus may further include a common circuit to be commonly used for controlling the first and second image forming sections; wherein the common circuit is provided on the control board.

Then, the first drive circuit may include the common circuit.

The connection section maybe connectable to a termination board having a termination function.

The first drive circuit may be mounted on the control board.

The image forming apparatus may further include a first board; wherein the first drive circuit is mounted on the first board; and the first board is connected to the control board.

The image forming apparatus may further include a common circuit to be commonly used for controlling the first and second image forming sections; wherein the common circuit is provided on the first board.

Further, the invention provides an image forming apparatus, including: a first image forming section for forming an image of first type; a second image forming section for forming an image of second type; and a control board having a connection section, the connection section to be connected to a first board on which a first drive circuit are mounted, the first drive circuit for driving the first image forming section and the second image forming section; wherein the connection section is connectable to a second board on which a second drive circuit is mounted, the second drive circuit differing from the first drive circuit in drive capability; and the second drive circuit can drive the first and second image forming sections when the second board is connected to the control board.

The second drive circuit may be substantially equal to the first drive circuit in terms of capability of driving the first image forming section; and the second drive circuit may differ from the first drive circuit in terms of capability of driving the second image forming section.

An image of first type formed by the first image forming section may be a monochrome image; while an image of second type formed by the second image forming section may be a color image.

The invention further provides an image forming apparatus, including: a first image forming section for forming an image of first type; a second image forming section for forming an image of second type; and a control board; wherein the control board is connected to a first drive circuit, the first drive circuit for driving the first image forming section; the control board has a connection section to be connected to a second board, the second board having a second drive circuit for driving the second image forming section for forming an image of second type; and the control board is moved from another image forming apparatus to be connected to the second board to thereby recycled.

The invention further provides an image forming apparatus, including: a first image forming section for forming an image of first type; a second image forming section for forming an image of second type; and a control board; wherein the control board is connected to a first drive circuit, the first drive circuit for driving the first image forming section; the control board has a connection section to be connected to a second board, the second board having a second drive circuit for driving the second image forming section for forming an image of second type; and the control board is moved from another image forming apparatus and recycled while being newly connected to the second board which differs in drive capability from that connected in the other image forming apparatus.

The invention further provides a control board of an image forming apparatus, wherein the image forming apparatus includes a first image forming section for forming an image of first type, the control board including: a first drive circuit for driving the first image forming section; and a connection section; wherein the connection section is connectable to a second board on which a second drive circuit for driving a second image forming section is mounted, the second image forming section for forming an image of second type.

The second board may include a plurality of second boards, each having the second drive circuit mutually different in capability; and the plurality of second boards are selectively connected to the connection section.

The first drive circuit may be of higher driving capacity than the second drive circuit.

The image of first type formed by the first image forming section may be a monochrome image; while the image of second type formed by the second image forming section may be a color image.

The control board of an image forming apparatus may further include a common circuit to be commonly used for controlling the first and second image forming sections.

The first drive circuit may include the common circuit.

The connection section maybe connectable to a termination board having a termination function.

The second board may be newly connected to the connection section; and the second board may be utilized in an image forming apparatus differing from the image forming apparatus.

The control board may be utilized in another image forming apparatus differing from the image forming apparatus in a state that the second board connected to the connection section is replaced with another second board which differs in capability from the second board.

The invention further provides a control board of an image forming apparatus, wherein the image forming apparatus includes a first image forming section for forming an image of first type, a first drive circuit for driving the first image forming section, and a first board on which the first drive circuit is mounted, the control board including: a connection section; wherein the connection section is connectable to a second board on which a second drive circuit for driving a second image forming section is mounted, the second image forming section for forming an image of second type; the control board is connected to the first board.

The invention further provides a control board of an image forming apparatus, wherein the image forming apparatus includes a first image forming section for forming an image of first type, and a second image forming section for forming an image of second type, the control board including: a connection section connected to a first board, the first board includes a first drive circuit for driving the first image forming section and the second image forming section; wherein the connection section is connected to a second board, the second board includes a second drive circuit differing in drive capability from the first drive circuit; and the control board can drive the first and second image forming sections.

The invention further provides a method for recycling an image forming apparatus, including: removing, from a first image forming apparatus, a control board on which is mounted a first drive circuit for driving the first image forming section for forming an image of first type or which has a connection section to be connected to a first board having the first drive circuit mounted thereon and to a second board having mounted thereon a second drive circuit for driving a second image forming section for forming an image of second type; connecting the control board to the second board; and providing the control board connected to the second board in a second image forming apparatus having the first image forming section for forming an image of first type and the second image forming section for forming an image of second type.

The invention further provides a method for recycling an image forming apparatus including: removing a control board from a first image forming apparatus, the apparatus having a first image forming section for forming an image of first type, a second image forming section for forming an image of second type, and a control board on which is mounted a first drive circuit for driving the first image forming section or which has a connection section to be connected to a first board having the first drive circuit mounted thereon and to a second board having mounted thereon a second drive circuit for driving the second image forming section for forming an image of second type; and placing, on a second image forming apparatus having the first and second image forming sections, a control board to which is newly connected a second board differing in driving capability from the second board connected to the control board.

The invention further provides a method for recycling a control board, including: removing, from a first image forming apparatus having the first image forming section, a control board on which is mounted a first drive circuit for driving a first image forming section for forming an image of first type or which has a connection section to be connected to a first board having the first drive circuit mounted thereon and to a second board having mounted thereon a second drive circuit for driving a second image forming section for forming an image of second type; connecting the control board to the second board; and utilizing the control board to which the second board is connected in a second image forming apparatus having the first and second image forming sections.

The invention further provides a method for recycling a control board, including: removing, from a first image forming apparatus having the first and second image forming sections, a control board on which is mounted a first drive circuit for driving the first image forming section for forming an image of first type or which has a connection section to be connected to a first board having the first drive circuit mounted thereon and to a second board having mounted thereon a second drive circuit for driving a second image forming section for forming an image of second type; connecting to the control board a second board differing in driving capacity from that connected to the control board in place of the second board; and utilizing the control board to which the second board is connected in a second image forming apparatus having the first and second image forming sections.

BRIEF DESCRIPTION OF THE DRAWINGS

The present invention may be more readily described with reference to the accompanying drawings:

FIG. 4 is a view showing several example combinations of a first drive circuit 12 and a second drive circuit 14;

DETAILED DESCRIPTION OF THE PREFERRED EMBODIMENTS

An embodiment of an image forming apparatus and a control board thereof, that of a method for recycling the image forming apparatus, and that of a method for recycling the control board according to the invention will be described hereinbelow in detail by reference to the accompanying drawings.

Figure 1:
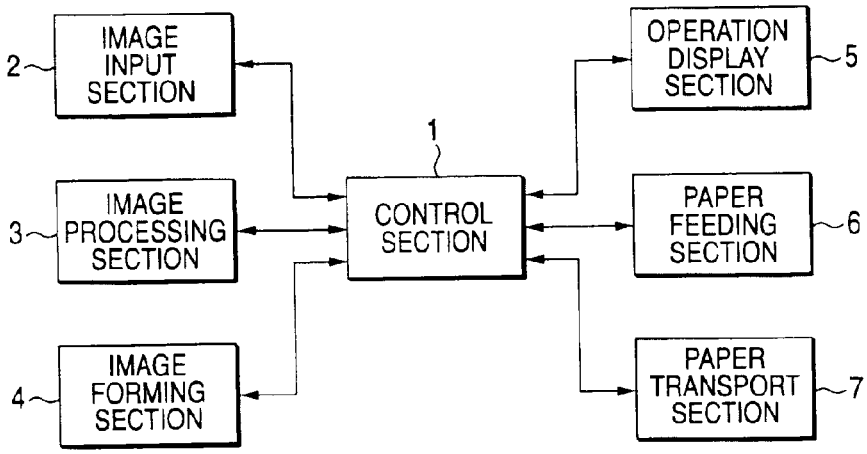
FIG. 1 is a block diagram showing a schematic configuration of an image forming apparatus.

FIG. 1 is a block diagram showing a schematic configuration of an image forming apparatus. As illustrated, the image forming apparatus comprises a control section 1, an image input section 2, an image processing section 3, an image forming section 4, an operation display section 5, a paper feeding section 6, and a paper transport section 7.

The control section 1 controls the other individual sections. The image input section 2 acquires received image data or image data obtained by means of reading an original. The image processing section 3 subjects image data to predetermined processing. The image forming section 4 forms an image on a medium such as paper or the like. The operation display section 5 displays acceptance of an operation instruction entered by a user and information to be offered to the user. The paper feeding section 6 feeds a medium such as paper or the like. The paper transport section 7 transports a medium supplied from the paper feeding section 6 to the image forming section 4.

Such a configuration enables recycling of components constituting the individual sections. Particularly, components constituting the control section 1 are immovable and suitable for recycling.

Therefore, the following explanations particularly describe a configuration for controlling the image forming section 4 among those employed for recycling the control section 1.

Figure 2:
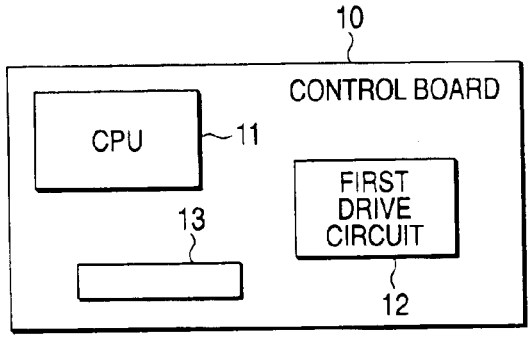
FIG. 2 is a view showing the configuration of a control board which is one of components constituting a control section 1.

FIG. 2 is a view showing the configuration of a control board, which is one of the components constituting the control section 1. As illustrated, the control board, denoted by reference numeral 10, is equipped with a CPU 11, a first drive circuit 12, and a connector 13.

The CPU 11 activates the control board 10 by execution of various programs. Although omitted from FIG. 2, ROM storing a program to be executed by the CPU 11 and RAM serving as a work area when the CPU 11 executes a program are actually provided on the control board 10.

The first drive circuit 12 is for driving the image forming section 4 and performs processing, such as control of a motor, receipt of outputs from various sensors, or the like.

Figure 3:
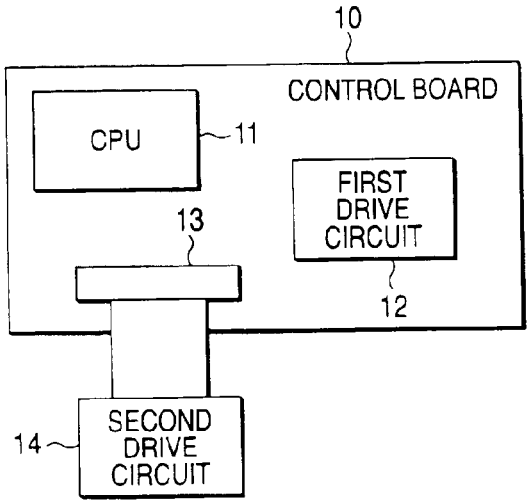
FIG. 3 is a view showing the configuration of a control board 10 when a second drive circuit 14 is connected thereto.

The connector 13 is to be used for connecting an additional circuit at the time of recycling of the control board 10. For example, as shown in FIG. 3, a second drive circuit 14 is connected to the connector 13. Like the first drive circuit 12, the second drive circuit 14 is for driving the image forming section 4. The second drive circuit 14 differs in function and performance from the first drive circuit 12. The second drive circuit 14 is not always to be connected at the time of recycling of the control board 10; there may be a case where another second drive circuit is to be connected to the connector 13 beforehand from the outset.

The first and second drive circuits 12, 14 will next be described. The first and second drive circuits 12, 14 are both for driving the image forming section 4; however, they differ in function or performance. A plurality of combinations of them are conceivable.

FIG. 4 is an illustration for showing several example combinations of the first and second drive circuits 12, 14.

First, an example combination denoted by A in the drawing shows that the first drive circuit 12 is equipped with all elements required to form a monochrome image; e.g., a black (K) color, (depicted as K[all] in the drawing), and that the second drive circuit 14 is equipped with all elements required to form a color image from images of colors (Y, M, C) (denoted as YMC [all] in the drawing). In this example, at the outset, the control board 10 is mounted in the control section of a monochrome-only machine. Subsequently, when the control board 10 is recycled in a color machine, the second drive circuit 14 is added to the control board 10. As a result, at the outset the control board 10 activates the image forming section 4 so as to form a monochrome image. Subsequently, the control board 10 activates the image forming section 4 to form both a monochrome image and a color image.

Naturally, the image forming section 4 employed in a monochrome-only machine differs in configuration from that employed in a color machine. The image forming section 4 of the color machine is constructed in such a manner as shown in, e.g., FIG. 5. As illustrated, the image forming section 4 of the color machine has, for respective colors, photosensitive members 41K, 41C, 41M, 41Y; charging sections 42K, 42C, 42M, 42Y; exposure sections 43K, 43C, 43M, 43Y; developing sections 44K, 44C, 44M, 44Y; transfer rollers 45K, 45C, 45M, 45Y; and cleaning sections 46K, 46C, 46M, 46Y. In addition, the image forming section 4 is equipped with an intermediate transfer member 47, and rollers 48-1, 48-2, 48-3 and 48-4.

Among the illustrated reference numerals, those having the suffix K designate sections for forming an image with a black recording agent (toner or the like). After the photosensitive member 41K has been charged by the charging section 42K, the exposure section 43K radiates a laser beam onto the photosensitive member 41K, thereby forming an electrostatic latent image on the photosensitive member 41K. The electrostatic latent image is developed with a black recording agent by the developer 44K. The thus-developed image is transferred onto the intermediate transfer member 47 by means of pressing action performed by the transfer roller 45K. Subsequently, the photosensitive member 41K is purged by the cleaning section 46K.

Similarly, those reference numerals having the suffix C designate sections for forming an image with a cyan recording agent. These operate in the same manner as do the sections for producing a black image. Moreover, those reference numerals having the suffix M designate sections for forming a magenta image, and those reference numerals having the suffix Y designate sections for forming a yellow image. These operate in the same manner as in the case of the sections for producing a black image.

In this way, the Y, M, C, K images transferred onto the intermediate transfer member 47 are transferred onto paper which is transported in the direction of arrow A in the drawing.

Figure 5:
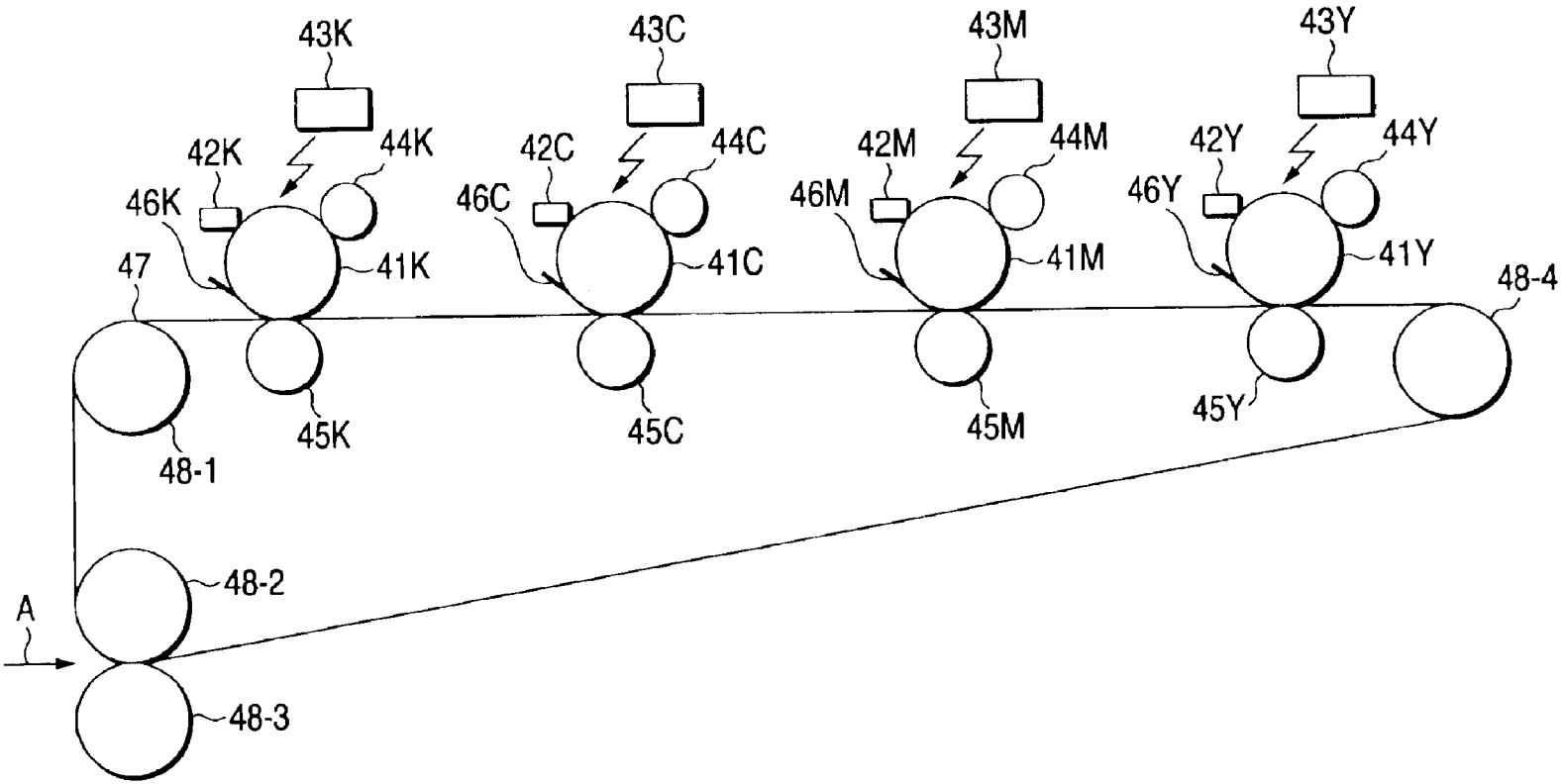
FIG. 5 is a view showing an example configuration of an image forming section 4 of a color machine.

In a case where the image forming section 4 has such a configuration as that shown in FIG. 5, the first drive circuit 12 controls the photosensitive member 41K, the charging section 42K, the exposure section 43K, the development section 44K, and the transfer roller 45K. The second drive circuit 14 controls the photosensitive members 41C, 41M, 41Y, the charging sections 42C, 42M, 42Y, the exposure sections 43C, 43M, 43Y, the development sections 44C, 44M, 44Y, and the transfer rollers 45C, 45M, 45Y.

In this way, drive circuits are separated for respective image forming sections which form images of different types. As a result, the first drive circuit can also be recycled at the time of recycling of the board, thus curtailing costs.

The example combination denoted by B in FIG. 4 shows that the first drive circuit 12 is equipped with all elements required to form a monochrome image, such as a black image, the elements including elements which can also be commonly used for forming color images; i.e., Y, M, C images {denoted as K[all] (+YMC [common]) in the drawing}, and that the second drive circuit 14 is equipped with only elements which are not commonly used for forming a monochrome image from among those required to form a color image; that is, elements which are not included in those provided on the first drive circuit 12 (denoted as YMC[others] in the drawing).

In this case, a portion of the drive circuit included in the second drive circuit 14 can be shared by the first drive circuit, thus curtailing costs.

The example combination denoted by C in FIG. 4 shows that elements commonly used for forming a monochrome image and a color image are mounted directly on the control board 10 (denoted as YMCK [common] in the drawing), that the first drive circuit 12 is equipped with only uncommon elements from among those employed for forming a monochrome image (denoted as K[others] in the drawing), and that the second drive circuit 14 is equipped with only uncommon elements from among the elements employed for forming a color image (denoted as YMC [others] in the drawing).

The example combination denoted by D in the FIG. 4 shows that the first drive circuit 12 is equipped with all elements required to form a monochrome image and a color image (denoted as YMCK [all] in the drawing), and that the second drive circuit 14 is equipped with only elements corresponding to a differential between higher performance elements required to form a monochrome image and a color image and those mounted on the first drive circuit 12 (denoted as YMCK [higher-level differential] in the drawing) In this example, the control board 10 is loaded on a color machine and subsequently loaded on a higher performance color machine.

Here, the combinations of the first and second drive circuits 12, 14 described above are mere examples, and various other combinations can be implemented.

Figure 6:
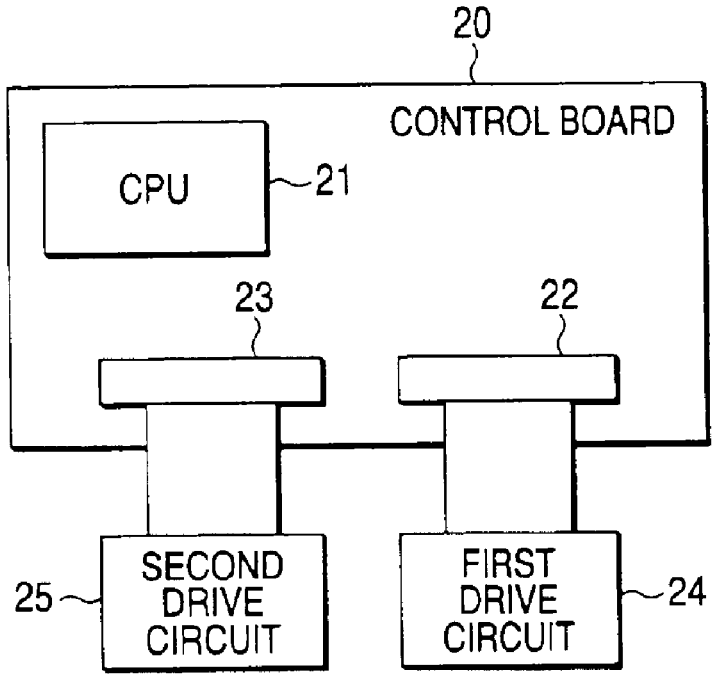
FIG. 6 is a view showing another example configuration of a control board.

The above descriptions mention that the first drive circuit 12 is mounted on the control board 10 and that the connector 13 to be used for making connection with the second drive circuit 14 is mounted on the control board 10. However, as in the case of a control board 20 shown in FIG. 6, the control board 20 may be equipped with a CPU 21 and connectors 22, 23. The first drive circuit 24 may be connected to the connector 22, and the second drive circuit 25 connected to the connector 23.

Figure 7A:
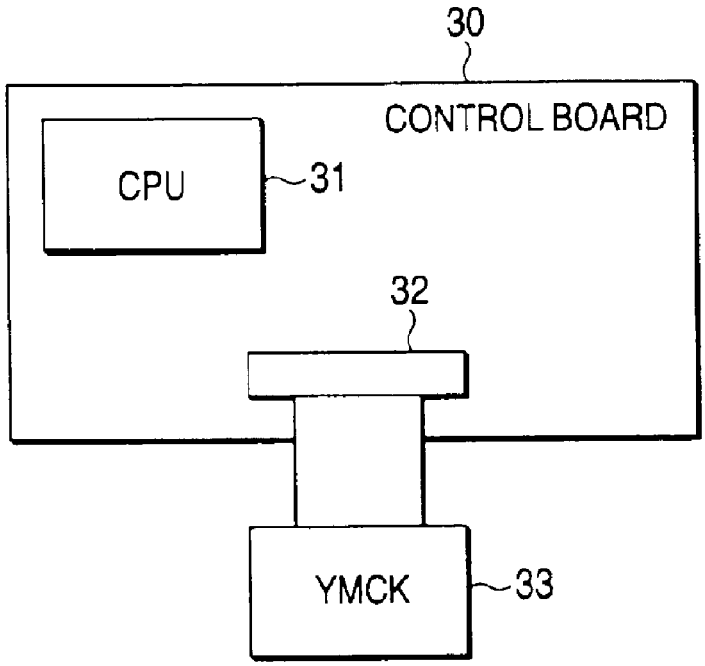
FIGS. 7A and 7B are views showing another example configuration of a control board.
Figure 7B:
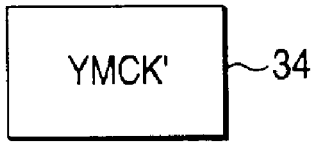

As shown in FIG. 7A, a control board 30 may be equipped with a CPU 31 and a connector 32. A drive circuit 33 for controlling formation of, e.g., a color image; that is, formation of a yellow (Y) image, a magenta (M) image, a cyan (c) image, and a black (K) image, may be connected to the connector 32. In this case, a drive circuit 34 shown in FIG. 7B can be connected to the connector 32 in place of the drive circuit 33. The drive circuit 34 controls formation of Y, M, C, K images in the same manner but is of superior performance to the drive circuit 33.

A drive circuit to be connected to the connection section 32 may be arranged such that a drive circuit for a monochrome image is first connected to the connection section 32 and such that a drive circuit for forming a color image is then connected to the connection section 32 at the time of recycling.

Subsequently, a control board (e.g., the control board 10) which is one of components constituting the control section 1 will be described in more detail.

Figure 8:
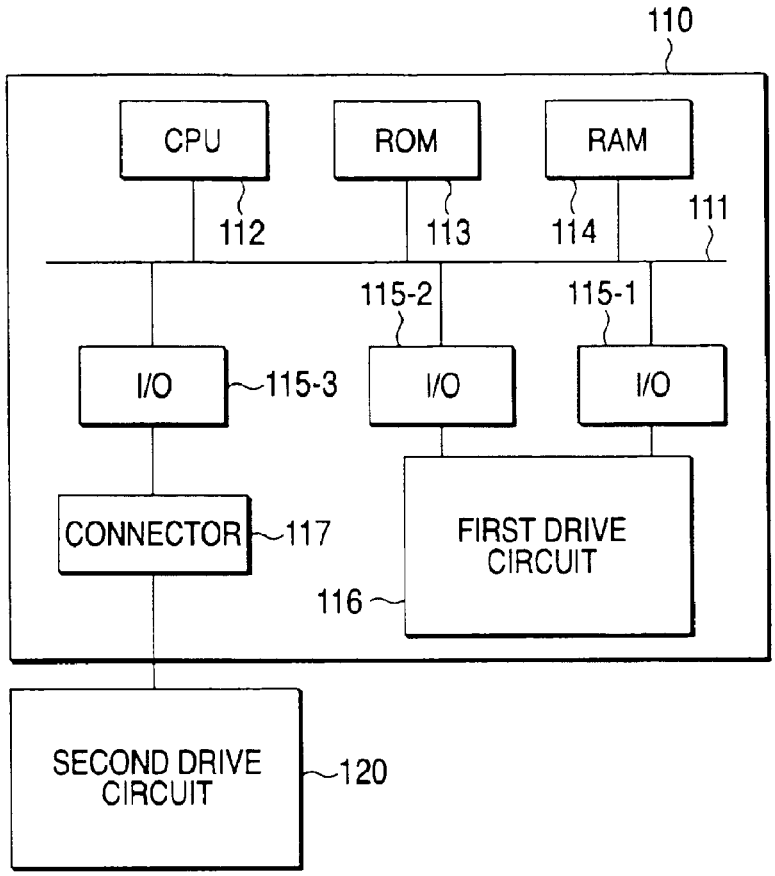
FIG. 8 is a view showing a detailed configuration of a control board.

FIG. 8 is a view showing the detailed configuration of the control board. As illustrated, in a control board 110, a bus 111 is connected to a CPU 112, ROM 113, RAM 114, and a plurality of I/O interfaces 115 (115-1 to 115-3). A first drive circuit 116 is connected to the bus 111 by way of the I/O interfaces 115-1 and 115-2. Further, a connector 117 is connected to the bus 111 by way of the I/O interface 115-3. A second drive circuit 120 is connected to the connector 117, as required.

In such a configuration, the connector 117 and the I/O interface 115-3, both being required for connecting the second drive circuit 120 to the control board 110, are mounted on the control board 110 in advance. Even when the second drive circuit is not required, the control board 110 is used in this state.

More I/O interfaces 115 may be mounted on the control board 110. In this case, uses of the I/O interfaces 115 are not necessarily determined beforehand when mounted on the control board 110.

Figure 9:
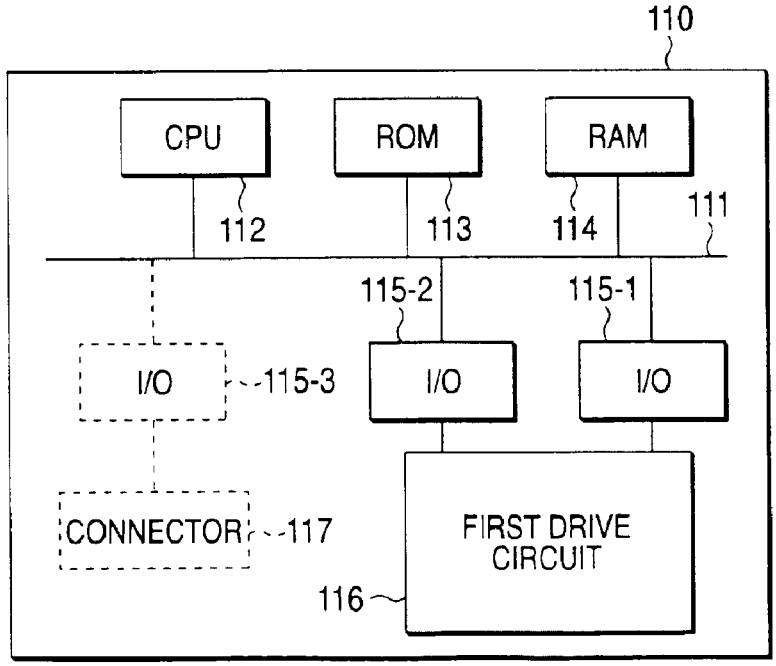
FIG. 9 is a view showing the configuration of a control board when a connector and an I/O interface are not mounted on the board.

There has been described a case where the connector 117 and the I/O interface 15-3, both being required for connecting the second drive circuit 120 to the control board 110, are mounted on the control board 110 beforehand. However, as shown in FIG. 9, it may be the case that initially the connector 117 and the I/O interface 115-3 are not mounted on the control board 110.

In this case, the connector 117 and the I/O interface 115-3 are mounted at the time of recycling of the control board 110. However, a printed pattern of the control board 110 may be designed beforehand such that the bus 111 is terminated when the I/O interface 115-3 is not mounted.

Figure 10:
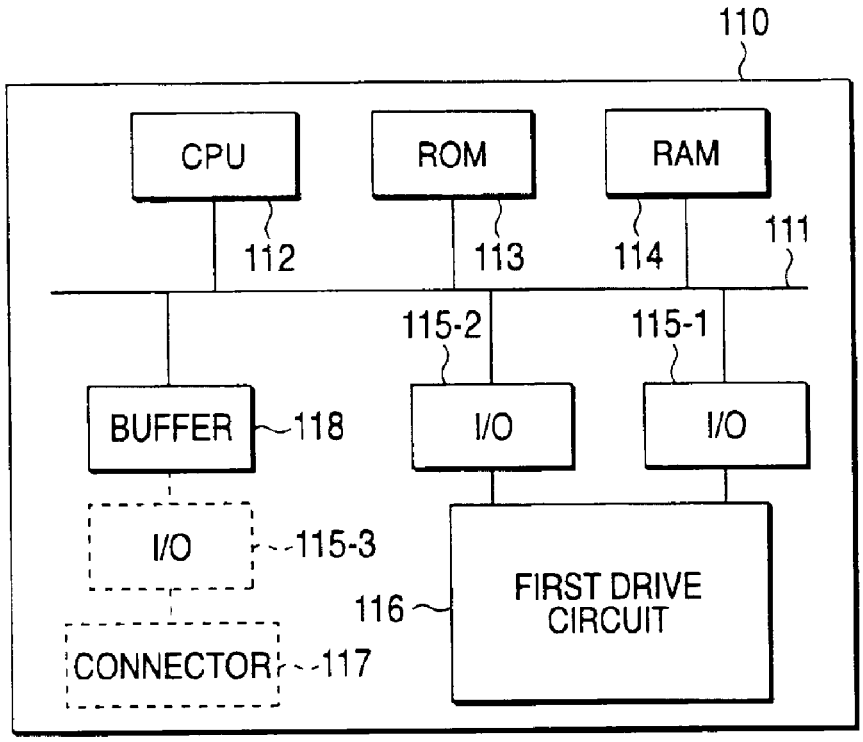
FIG. 10 is a view showing the configuration of the control board equipped with a buffer.

When the connector 117 and the I/O interface 115-3 are not mounted on a control board, a buffer 118 may be mounted as shown in FIG. 10 in place of the bus 111 being terminated with a printed pattern or the like. When the connector 117 and the I/O interface 115-3 are mounted, the buffer 118 operates so as to connect the bus 111 to the connector 117 and the I/O interface 115-3.

Figure 11A:
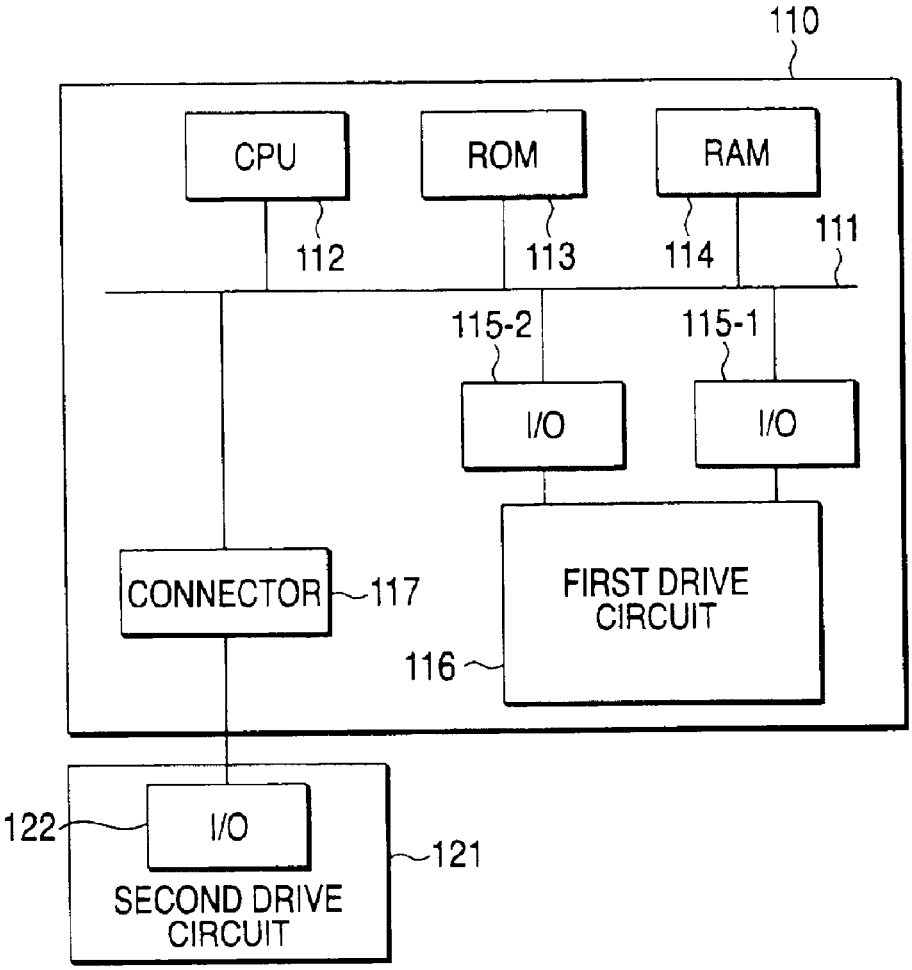
FIGS. 11A and 11B are views showing the configuration of the control board when an I/O interface is connected to a second drive circuit.
Figure 11B:
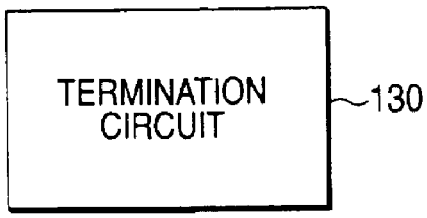

As shown in FIG. 11A, an I/O interface 122 may be mounted on the second drive circuit 121 without the I/O interface 115-3 being mounted on the control board 110. In such a configuration, when the second drive circuit 121 is not connected to the control board 110, a terminal circuit 130 such as that shown in FIG. 11B is connected to the connector 117.

Subsequently, preparation of the control board will now be described. In general, a board has a recommended size; however, a control board does not necessarily assume a recommended size. In such a case, a control board is prepared by cutting a board of recommended size.

Figure 12A:
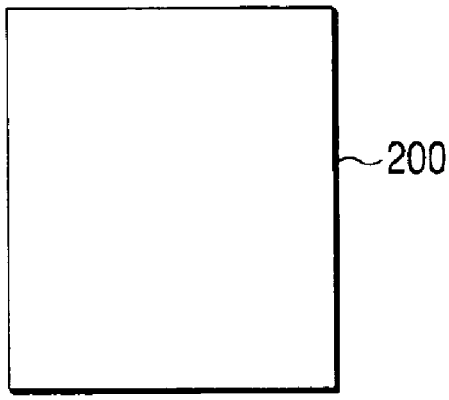
FIGS. 12A and 12B are views showing an example in which a board is cut.
Figure 12B:
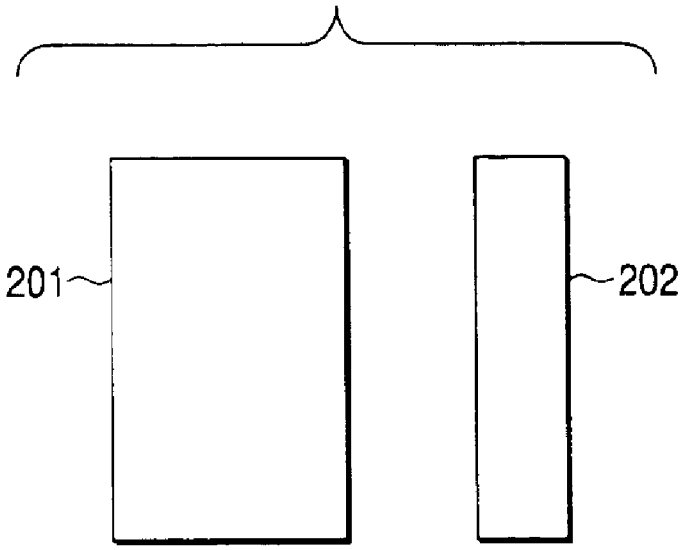

For example, when a smaller control board is produced from a board 200 of recommended size, such as that shown in FIG. 12A, the board 200 is split into a control board 201 and a waste board 202, as shown in FIG. 12B.

The waste board 202 is unwanted. However, a second drive circuit can be formed by utilization of the waste board 202, or the waste board 202 may be utilized for mounting components at the time of recycling of the control board 201.

FIG. 13 is a view for describing an example of utilization of a waste board at the time of recycling of a control board. As shown in FIG. 13A, a connector 220 is presumed to be mounted at the time of recycling of the control board 210. However, there may arise a case where a component extending off a board cannot be mounted, because of restrictions imposed on an automatic machine for mounting components. In such a case, as shown in FIG. 13B, the waste board 211 is connected to the control board 210, thereby enabling the automatic machine to mount the connector 220.

Figure 13A:
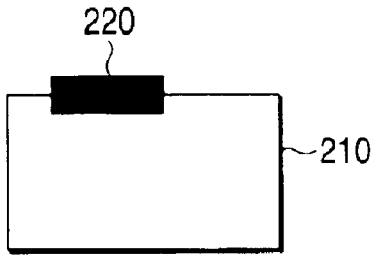
FIGS. 13A, 13B, 13C, 13D, 13E and 13F are views for describing an example of utilization of a waste board at the time of recycling of the control board.
Figure 13B:
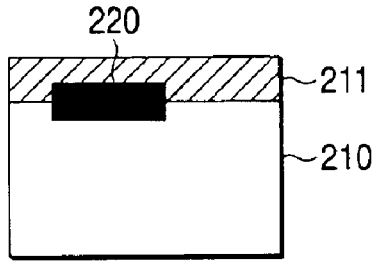
Figure 13C:
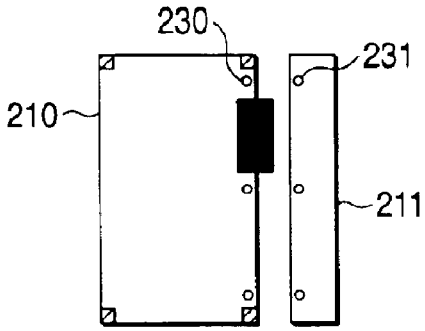
Figure 13D:
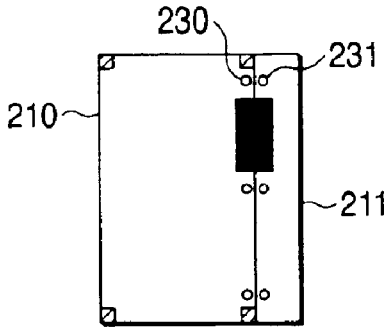

As shown in FIG. 13C, connection holes 230 are drilled in the control board 210, and connection holes 231 are drilled in the waste board 211. As shown in FIG. 13D, the control board 210 and the waste board 211 are connected together.

Figure 13E:
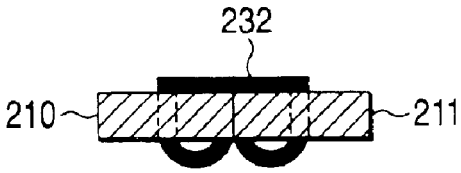
Figure 13F:
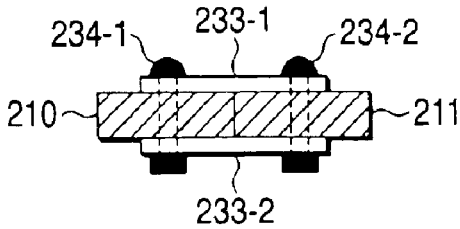
Figure 14:
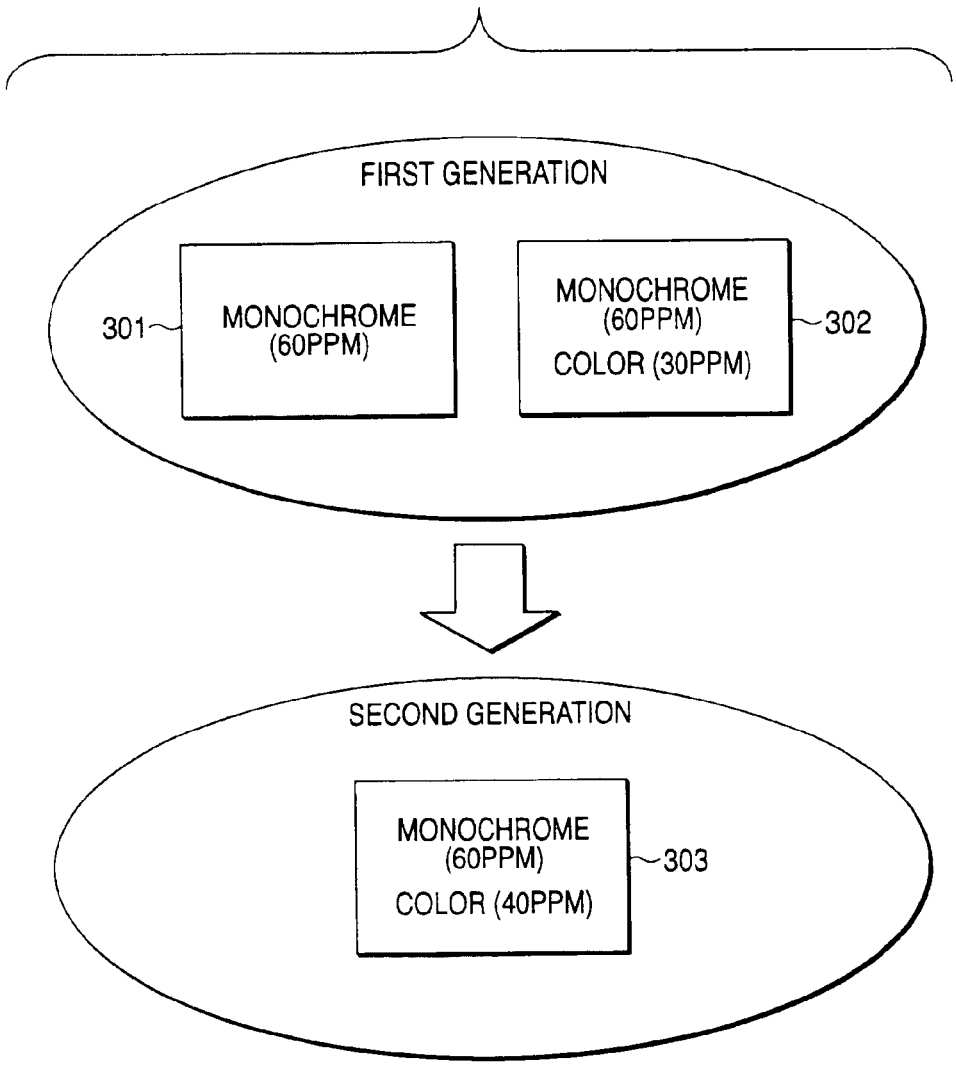
FIG. 14 is a view for describing flow of transformation of an image forming apparatus.

Various methods maybe employed for connecting the control board 210 and the waste board 211 together; for example, a method utilizing a staple needle 232 as shown in FIG. 13E or a method utilizing plates 233-1, 233-2 and bolts 234-1, 234-2 as shown in FIG. 13F.

The above descriptions pertain to the board that controls the image forming section 4 as a control board to be recycled. However, a control board for controlling the image input section 2, a control board for controlling the image processing section 3, and another control board can be recycled in the same manner.

As has been described, the invention enables recycling of a control board.

What is claimed is:

1. An image forming apparatus, comprising:

a first image forming section for forming an image of first type;

a control board; and a first drive circuit for driving the first image forming section;

wherein the first drive circuit is connected to the control board; and the control board has a connection section to be connected to a second board on which a second drive circuit for driving a second image forming section is mounted, the second image forming section for forming an image of second type.

2. The image forming apparatus according to claim 1, wherein the second board includes a plurality of second boards, each having the second drive circuit mutually different in capability; and the plurality of second boards are selectively connected to the connection section.

3. The image forming apparatus according to claim 1, wherein the first drive circuit is of higher driving capacity than the second drive circuit.

4. The image forming apparatus according to claim 1, wherein the image of first type formed by the first image forming section is a monochrome image; and the image of second type formed by the second image forming section is a color image.

5. The image forming apparatus according to claim 1, further comprising a common circuit to be commonly used for controlling the first and second image forming sections;

wherein the common circuit is provided on the control board.

6. The image forming apparatus according to claim 5, wherein the first drive circuit includes the common circuit.

7. The image forming apparatus according to claim 1, wherein the connection section is connectable to a termination board having a termination function.

8. The image forming apparatus according to claim 1, wherein the first drive circuit is mounted on the control board.

9. The image forming apparatus according to claim 1, further comprising:

a first board;

wherein the first drive circuit is mounted on the first board; and the first board is connected to the control board.

10. The image forming apparatus according to claim 9, further comprising a common circuit to be commonly used for controlling the first and second image forming sections;

wherein the common circuit is provided on the first board.

11. An image forming apparatus, comprising:

a first image forming section for forming an image of first type;

a second image forming section for forming an image of second type; and a control board having a connection section, the connection section to be connected to a first board on which a first drive circuit are mounted, the first drive circuit for driving the first image forming section and the second image forming section;

wherein the connection section is connectable to a second board on which a second drive circuit is mounted, the second drive circuit differing from the first drive circuit in drive capability; and the second drive circuit can drive the first and second image forming sections when the second board is connected to the control board.

12. The image forming apparatus according to claim 11 wherein the second drive circuit is substantially equal to the first drive circuit in terms of capability of driving the first image forming section; and the second drive circuit differs from the first drive circuit in terms of capability of driving the second image forming section.

13. The image forming apparatus according to claim 11 wherein an image of first type formed by the first image forming section is a monochrome image; and an image of second type formed by the second image forming section is a color image.

14. An image forming apparatus, comprising:

a first image forming section for forming an image of first type;

a second image forming section for forming an image of second type; and a control board;

wherein the control board is connected to a first drive circuit, the first drive circuit for driving the first image forming section;

the control board has a connection section to be connected to a second board, the second board having a second drive circuit for driving the second image forming section for forming an image of second type; and the control board is moved from another image forming apparatus to be connected to the second board to thereby recycled.

15. An image forming apparatus, comprising:

a first image forming section for forming an image of first type;

a second image forming section for forming an image of second type; and a control board;

wherein the control board is connected to a first drive circuit, the first drive circuit for driving the first image forming section;

the control board has a connection section to be connected to a second board, the second board having a second drive circuit for driving the second image forming section for forming an image of second type; and the control board is moved from another image forming apparatus and recycled while being newly connected to the second board which differs in drive capability from that connected in the other image forming apparatus.

16. A control board of an image forming apparatus, wherein the image forming apparatus includes a first image forming section for forming an image of first type, the control board comprising:

a first drive circuit for driving the first image forming section; and a connection section;

wherein the connection section is connectable to a second board on which a second drive circuit for driving a second image forming section is mounted, the second image forming section for forming an image of second type.

17. The control board of an image forming apparatus according to claim 16, wherein the second board includes a plurality of second boards, each having the second drive circuit mutually different in capability; and the plurality of second boards are selectively connected to the connection section.

18. The control board of an image forming apparatus according to claim 16, wherein the first drive circuit is of higher driving capacity than the second drive circuit.

19. The control board of an image forming apparatus according to claim 16, wherein the image of first type formed by the first image forming section is a monochrome image; and the image of second type formed by the second image forming section is a color image.

20. The control board of an image forming apparatus according to claim 16, further comprising:

a common circuit to be commonly used for controlling the first and second image forming sections.

21. The control board of an image forming apparatus according to claim 20, wherein the first drive circuit includes the common circuit.

22. The control board of an image forming apparatus according to claim 16, wherein the connection section is connectable to a termination board having a termination function.

23. The control board of an image forming apparatus according to claim 16, wherein the second board is newly connected to the connection section; and the second board is utilized in an image forming apparatus differing from the image forming apparatus.

24. The control board of an image forming apparatus according to claim 16, wherein the control board is utilized in another image forming apparatus differing from the image forming apparatus in a state that the second board connected to the connection section is replaced with another second board which differs in capability from the second board.

25. A control board of an image forming apparatus, wherein the image forming apparatus includes a first image forming section for forming an image of first type, a first drive circuit for driving the first image forming section, and a first board on which the first drive circuit is mounted, the control board comprising:

a connection section;

wherein the connection section is connectable to a second board on which a second drive circuit for driving a second image forming section is mounted, the second image forming section for forming an image of second type;

the control board is connected to the first board.

26. A control board of an image forming apparatus, wherein the image forming apparatus includes a first image forming section for forming an image of first type, and a second image forming section for forming an image of second type, the control board comprising:

a connection section connected to a first board, the first board includes a first drive circuit for driving the first image forming section and the second image forming section;

wherein the connection section is connected to a second board, the second board includes a second drive circuit differing in drive capability from the first drive circuit; and the control board can drive the first and second image forming sections.

27. A method for recycling an image forming apparatus, comprising:

removing, from a first image forming apparatus, a control board on which is mounted a first drive circuit for driving the first image forming section for forming an image of first type or which has a connection section to be connected to a first board having the first drive circuit mounted thereon and to a second board having mounted thereon a second drive circuit for driving a second image forming section for forming an image of second type;

connecting the control board to the second board; and providing the control board connected to the second board in a second image forming apparatus having the first image forming section for forming an image of first type and the second image forming section for forming an image of second type.

28. A method for recycling an image forming apparatus comprising:

removing a control board from a first image forming apparatus, the apparatus having a first image forming section for forming an image of first type, a second image forming section for forming an image of second type, and a control board on which is mounted a first drive circuit for driving the first image forming section or which has a connection section to be connected to a first board having the first drive circuit mounted thereon and to a second board having mounted thereon a second drive circuit for driving the second image forming section for forming an image of second type; and placing, on a second image forming apparatus having the first and second image forming sections, a control board to which is newly connected a second board differing in driving capability from the second board connected to the control board.

29. A method for recycling a control board, comprising:

removing, from a first image forming apparatus having the first image forming section, a control board on which is mounted a first drive circuit for driving a first image forming section for forming an image of first type or which has a connection section to be connected to a first board having the first drive circuit mounted thereon and to a second board having mounted thereon a second drive circuit for driving a second image forming section for forming an image of second type;

connecting the control board to the second board; and utilizing the control board to which the second board is connected in a second image forming apparatus having the first and second image forming sections.

30. A method for recycling a control board, comprising:

removing, from a first image forming apparatus having the first and second image forming sections, a control board on which is mounted a first drive circuit for driving the first image forming section for forming an image of first type or which has a connection section to be connected to a first board having the first drive circuit mounted thereon and to a second board having mounted thereon a second drive circuit for driving a second image forming section for forming an image of second type;

connecting to the control board a second board differing in driving capacity from that connected to the control board in place of the second board; and utilizing the control board to which the second board is connected in a second image forming apparatus having the first and second image forming sections.

31. An image forming apparatus, comprising:

a first image forming section for forming an image of first type;

a control board; and a first drive circuit for driving the first image forming section;

wherein the first drive circuit is equipped with a selected single or plurality of color elements, the first drive circuit is connected to the control board; and the control board has a connection section to be connected to a second board on which a second drive circuit for driving a second image forming section is mounted, wherein the second drive circuit is equipped with a selected single or plurality of color elements not used in the first drive circuit; and the second image forming section for forming an image of second type.

32. A control board of an image forming apparatus, wherein the image forming apparatus includes a first image forming section for forming an image of first type, the control board comprising:

a first drive circuit for driving the first image forming section, wherein the first drive circuit is equipped with a selected single or plurality of color elements; and a connection section;

wherein the connection section is connectable to a second board on which a second drive circuit for driving a second image forming section is mounted, wherein the second drive circuit is equipped with a selected single or plurality of color elements not used in the first drive circuit; and the second image forming section for forming an image of second type.

33. An image forming apparatus, comprising:

a first image forming section for forming an image of first type;

a control board; and a first drive circuit for driving the first image forming section;

wherein the first drive circuit is connected to the control board;

the control board has a connection section to be connected to a second board on which a second drive circuit for driving a second image forming section is mounted, the second image forming section for forming an image of second type; and the control board is removable from the second board.

34. An image forming apparatus, comprising:

a first image forming section for forming an image of first type;

a second image forming section for forming an image of second type; and a control board;

wherein the control board is connected to a first drive circuit, the first drive circuit for driving the first image forming section;

the control board has a connection section to be connected to a second board, the second board having a second drive circuit for driving the second image forming section for forming an image of second type.

35. An image forming apparatus, comprising:

a first image forming section for forming an image of first type;

a second image forming section for forming an image of second type; and a control board;

wherein the control board is connected to a first drive circuit, the first drive circuit for driving the first image forming section;

the control board has a connection section to be connected to a second board, the second board having a second drive circuit for driving the second image forming section for forming an image of second type; and the control board is removable from the second board.

* * * * *